United States Patent [19]

Raux et al.

[11] 4,373,770

[45] Feb. 15, 1983

[54] ELECTRICAL CONNECTOR WITH TACTILE LOCKING TELLTALE

[75] Inventors: Jacques Raux, Meudon la Forêt; Jacques Benoist, St. Cloud, both of France

[73] Assignee: Souriau & Cie, Boulogne-Billancourt, France

[21] Appl. No.: 143,597

[22] Filed: Apr. 25, 1980

[30] Foreign Application Priority Data

May 8, 1979 [FR] France ..... 79 11609

[51] Int. Cl.[3] ..... H01R 13/64

[52] U.S. Cl. ..... 339/113 R

[58] Field of Search ..... 339/89, 90, 113, DIG. 2, 339/91 B

[56] References Cited

U.S. PATENT DOCUMENTS 3,555,490 1/1971 Williams ..... 339/DIG. 2

3,801,954 4/1974 Dorrell ..... 339/DIG. 2

FOREIGN PATENT DOCUMENTS 2033174A 5/1980 United Kingdom ..... 339/113 R

*Primary Examiner*—Joseph H. McGlynn

*Attorney, Agent, or Firm*—McAulay, Fields, Fisher, Goldstein & Nissen

[57] ABSTRACT

An electrical connector has a socket member (1) with a body portion (2) having a tubular leading part (3) into which the tubular leading part (8) of a body portion (7) of a plug member (6) can engage. Locking is effected by means of a ring (11) which is retained on the plug member (6) and provided with an internal screw thread (14) co-operating with an external screw thread (5) on the leading part (3). When the ring (11) is screwed onto the socket (1) a leading end face (18) of the socket (1) is applied against an inclined face (17) of a tactile telltale (16) which is thereby urged outwardly of the ring (11) against the force of a return spring (19) to give a tactile indication to an inspector that the connector, which may be outside the field of vision of the inspector, is fully engaged.

12 Claims, 2 Drawing Figures

ELECTRICAL CONNECTOR WITH TACTILE LOCKING TELLTALE

Figure 1:
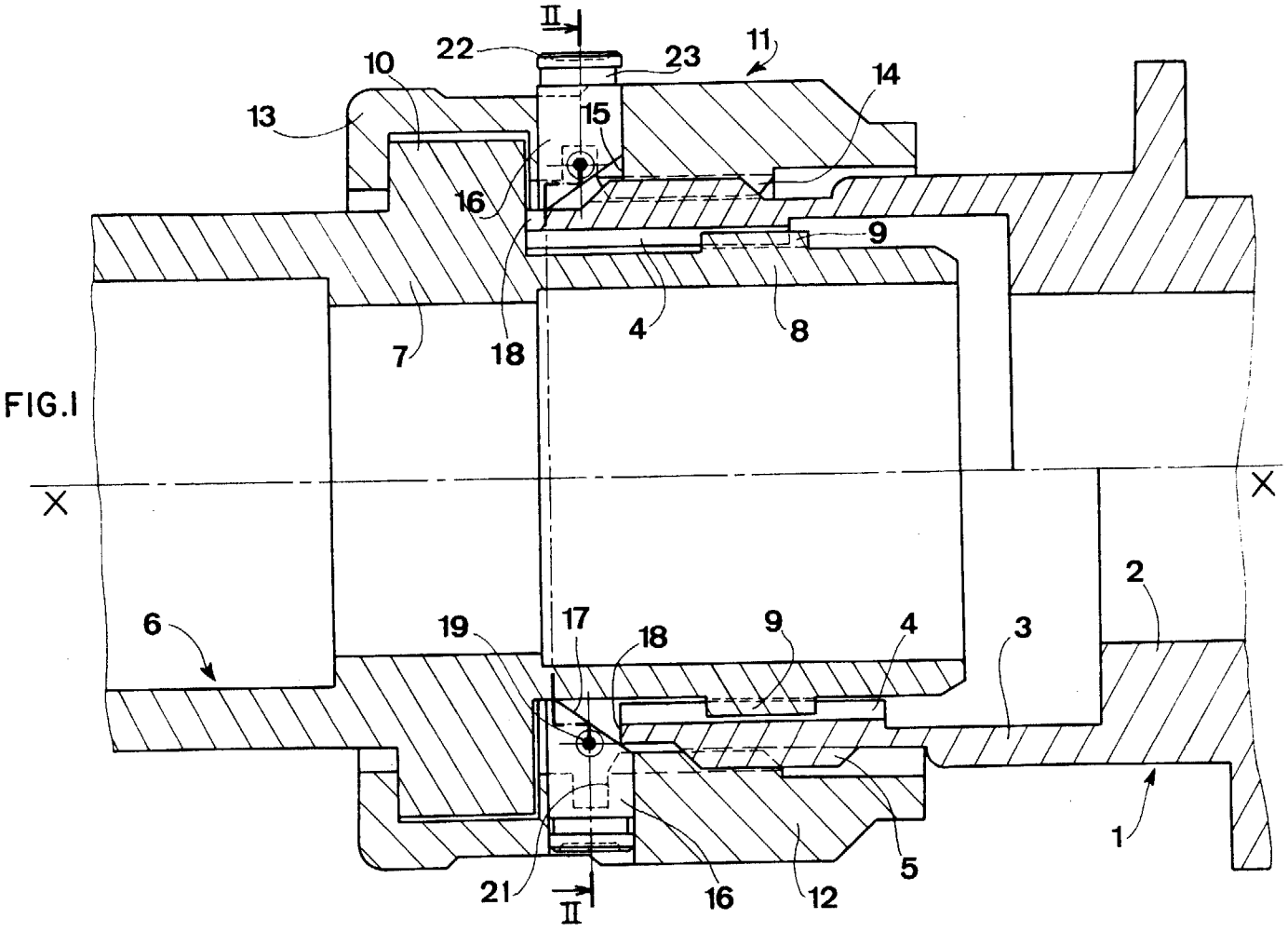

The invention concerns an electrical connector having a tactile locking telltale.

Electrical connectors have been previously proposed, which comprise a socket member with a body portion of generally tubular shape to receive at least one contact terminal, for example of male type, retained by a resilient clip in an insulating sheath which is itself positioned, for example, by a key member, in the socket member body portion, and has a leading part into which a corresponding leading part of a body portion of a plug member is capable of engaging, by axial translatory movement along the longitudinal axis of the socket member body portion, corresponding to the longitudinal axis of the connector. The plug member body portion being is of generally tubular shape and intended to receive at least one contact terminal co-operating with the socket member terminal or terminals, for example, a terminal of female type, which is retained by a resilient clip in an insulating sheath which is itself positioned, for example, by a key member, in the plug member body portion. The connector being is locked in the position of co-operation between the plug member and socket member terminals by means of a locking ring which is also of generally tubular shape. The ring is retained on the plug and which has a part which surrounds the leading part of the plug and its internal surface carries fixing means intended to co-operate with complementary fixing means carried on the external surface of the leading part of the socket member body portion, for example, corresponding screw threads, to provide for connection between the plug member and the socket member and for locking that connection.

Such connectors give only a visual indication for indicating the locking position. This indication is usually in the form of a line or mark of clearly identifiable paint, for example red paint, which covers the trailing part of the external screw thread of the socket member body portion and which is entirely covered and hidden from the view of an inspector when the internally screw threaded ring is completely screwed onto the socket member body portion, as must be the case at the end of a completed locking operation. However, in some of the uses to which these connectors are put, in particular in the equipment of aircraft engines, such connectors are sometimes disposed in positions such that they are out of sight of an inspector who, on examining the engine, is unable visually to check that the connector is in fact in the locked position. Yet, such connectors are within the reach of the fingers of the inspector or tools the inspector is handling.

According to the invention there is provided an electrical connector comprising a socket member with a body portion of generally tubular form, to receive at least one contact terminal, having a leading part in which a corresponding leading part of a body portion of a plug member can be engaged by axial translatory movement along the longitudinal axis of the socket member body portion, which axis corresponds to the longitudinal axis of the connector. The body portion of the plug member is of generally tubular form to receive at least one contact terminal co-operating with the terminal or terminals of the socket member. The connector can be secured in the position of co-operation of the terminals of the plug member and socket member by a locking ring. The locking ring is also of generally tubular form, is retained on the plug member and has a part with an internal surface with fixing means, which can co-operate with complementary fixing means carried on the external surface of the leading part of the body portion of the socket member to provide a connection between the plug member and the socket member and locking of said connection. A radial passage in said part of the ring and a tactile locking telltale received in said passage, urged resiliently inwardly of the ring and pressed in the opposite direction by the body portion of the socket member so that it projects outwardly of the ring when the connector is in a fully engaged position.

In a preferred embodiment, the tactile locking telltale is in the form of a cylindrical pin member having an inclined surface at its inner end, against which inclined surface the body portion of the socket member bears.

Advantageously, the telltale is resiliently urged inwardly of the ring, in all positions except the fully engaged position, by a spring in the form of a steel wire which passes through the pin member parallel to the inclined face and has its two ends supported in an annular groove provided in the internal surface of the ring, perpendicularly to the longitudinal axis of the connector, and opening into the radial passage, the middle part of the steel wire on respective sides of the pin member being retracted into the groove when the pin member is pushed by the body portion of the socket to a position in which it extends outwardly of the ring.

In an embodiment which is of great simplicity, detection of the projecting position of a portion of the pin member, in the locked position, is facilitated if an annular groove is provided on the pin member in the vicinity of its outer end, in the portion which projects from the ring in the fully engaged position of the connector.

Figure 2:
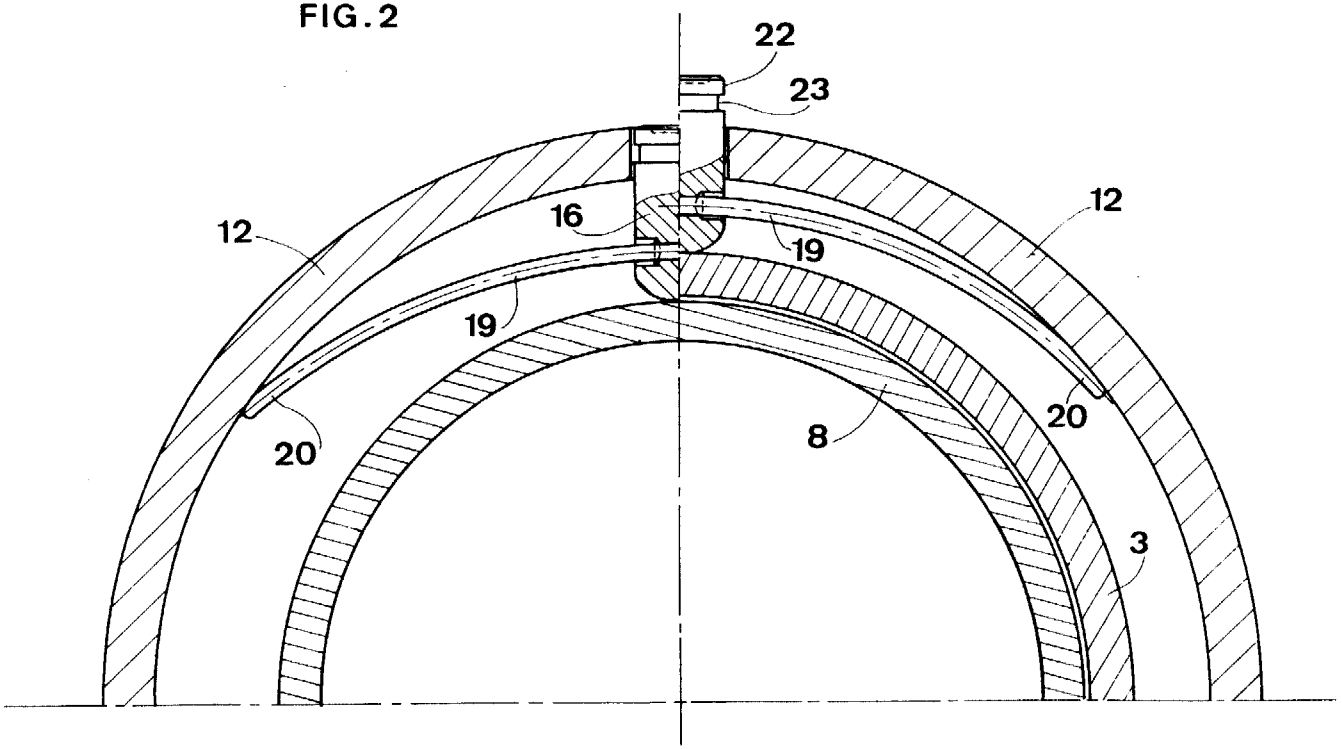

The invention is diagrammatically illustrated by way of example in the accompanying drawings, wherein:

FIG. 1 is a view in partial section of a connector according to the invention, wherein contact terminals and other members providing for positioning thereof and retention thereof in the connector are, for clarity, not shown, the lower half showing a non-locked position while the upper half shows the locked position; and FIG. 2 shows a view of half of the same connector in section taken along line II—II in FIG. 1, the left-hand part corresponding to a non-locked position and the right-hand part corresponding to the locked position.

Referring to the drawings, a connector comprises a socket member 1 with a body portion 2 having a leading part 3 of generally tubular form provided internally with a longitudinal groove 4 extending parallel to the longitudinal axis XX of the body portion 2 and corresponding to the longitudinal axis of the connector. On its external surface the leading part 3 carries a screw thread 5. The connector also comprises a plug member 6 with a body portion 7 having a leading part 8 of generally tubular form with, on its outside surface, a guide key member 9. Rearwardly of the leading part 8, the plug body portion 7 has an external shoulder 10 for engagement by a locking ring 11 on the plug 6, the locking ring 11 having a part 12 which is also of generally tubular form and which is disposed around the leading parts 8 of the plug member 6, and a flange 13 which is crimped behind the shoulder 10. On its internal surface, the part 12 of the ring 11 carries a screw thread 14 which is complementary to the external screw thread 5 on the leading part 3 of the body portion 2 of the socket member 1.

A radial passage 15 is provided in ring 11 at the junction of the parts 12, 13 and clear of the internal screw thread 14, and receives a tactile locking telltale 16. The telltale 16 is in the form of a cylindrical pin member which has, in its portion which is disposed inwardly of the connector, an inclined surface 17 whose angle of inclination with respect to the axis XX is so selected that the telltale 16 is caused to slide radially in the passage 15, outwardly of the ring 11, when the end 18 of the leading part 3 of the socket body portion 2 is pushed against the telltale 16, when the plug 6 is introduced into the socket 1, with a translatory movement parallel to the axis XX, being guided by the key member 9 of the plug 6 engaged in the longitudinal groove 4 in the socket 1, in the course of a connecting operation. The tactile telltale 16 is therefore caused to slide outwardly when, by screwing the locking ring 11 onto the leading part 3 of the socket body portion 2, the leading part 8 of the plug 6 is caused to be introduced into the leading part 3 of the socket 1, and said parts are secured together by the end 18 of the socket 1 bearing against the shoulder 10 of the plug 6. This sliding movement is produced against the action of a return spring urging the tactile telltale 16 inwardly of the ring 11, butting against the external surface of the leading part 8 of the plug 6. The spring comprises a steel wire 19 which passes through the telltale 16 in the vicinity of the inclined cut surface 17, along a direction parallel to the surface 17 and perpendicular to the axis XX, and the two ends 20 of the steel wire 19 are supported in an annular groove 21 which is provided in the internal surface of the body portion 12 of the ring 11, perpendicularly to the axis XX, and which opens into the radial passage 15 in such a way that the central part of the steel wire 19, on respective sides of the tactile telltale 16, is retracted into the groove 21 in the locking operation, and does not prevent the threads of the screw thread 5 of the socket 1 from passing.

The length of the telltale 16 is such that, in the initial position, before connection, the telltale 16 is entirely retracted into the ring 11.

On the other hand, after connection and maximum screwing of the ring 11 on the socket 1, which corresponds to the fully engaged position, an outer end portion 22 of the telltale 16 projects clearly outwardly of the ring 11. To enhance the projection effect, an annular groove 23 is formed below the outer end portion 22 of the telltale 16 so that the projecting position of the telltale 16 can be more easily detected with the nail of a finger of an inspector or with a tool such as a screwdriver. As the telltale 16 is made of steel, the resulting indicator device can be used on connectors which are required to withstand ambient temperatures as high as 900° to 1000° C., as are likely to be encountered in aircraft engines. The connector is advantageously used whenever a connection is to be made and locked outside the field of vision of an inspector or operator who however is able to confirm that the connection has been made, by touch.

We claim:

1. A connector having locking indication means for providing an indication within the reach of the fingers of the inspector or tools the inspector is handling when the inspector is unable visually to check the connector comprising a socket having at least one contact terminal and a leading part and a plug member having at least one contact terminal cooperating with said contact terminal on said socket and having a leading part engageable in the leading part of said socket by axial longitudinal movement of said plug therein;

securing means on the outside of said leading part of said socket;

a locking ring for securing in cooperating position said terminals on said plug and said socket;

said ring being retained on said plug and having a leading part thereof provided with complementary securing means on the inner surface thereof cooperating with said securing means on said socket to connect said plug and said socket and lock same;

a radial passage in said leading part of said ring;

tactile locking telltale means received in said passage having said locking indication means;

resilient means on said ring urging said telltale means inwardly of said ring and pressed in the opposite direction by said socket so that said locking indication means projects outwardly of said ring and said connector when said plug and said socket are properly coupled to afford the inspector the opportunity to check said locking indication means when said locking indication means is not visible to the inspector for visually checking said connector;

said telltale means consisting of a pin having an inner end, said end having a surface inclined along the longitudinal axis of said connector and bearing against the inner end of said socket;

said resilient means consisting of a return spring passing through said pin parallel to the inclined surface thereof;

said ring having an internal groove perpendicular to said longitudinal axis of said connector;

said spring being supported in said groove;

the middle of said spring on each side of said pin being retractable into said groove when said pin is urged by said socket outwardly of said ring.

2. The connector of claim 1, wherein said pin has an annular groove in the outer portion thereof projecting from said connector in the fully engaged position of said plug and socket.

3. The connector of claim 1, wherein said ring is threaded along a part of its internal surface and said socket is complementarily threaded along said leading part thereof.

4. The connector of claim 1, wherein said socket has an inner longitudinal groove and said plug has an outer key member adapted to be guided by said groove when connecting said plug with said socket.

5. The connector of claim 1, wherein said plug has an external shoulder and said ring has a flanged portion crimped behind said shoulder.

6. The connector of claim 1, particularly adapted for use with aircraft engines, wherein said spring is formed of steel.

7. The connector of claim 1, wherein the length of said pin is such that, before connection, said pin is substantially entirely retracted into said ring.

8. A ring for locking in fully engaged position the members of a connector assembly comprising a plug received on a socket, said ring comprising a tubular member fitting around said assembly for retention thereon;

a radial passage in said ring;

a tactile locking telltale means received in said passage having locking indication means;

said telltale means consisting of a pin having an inner end provided with a surface inclined along the longitudinal axis of said ring and adapted to be pushed outwardly of said ring by one of said members of said assembly to move said locking indication means into a position enabling an inspector to inspect said locking indication means with a tool; and spring means resiliently urging said pin inwardly of said ring;

said resilient means consisting of a return spring passing through said pin parallel to the inclined surface thereof;

said ring having an internal groove therein;

said spring being supported in said groove;

the middle of said spring on each side of said pin being retractable into said groove when said pin is urged by said socket outwardly of said ring.

9. The ring of claim 8, wherein said pin has an annular groove in the outer portion thereof projecting from said ring in the fully engaged position of said plug and socket.

10. The ring of claim 8, wherein said ring is threaded along a part of its internal surface.

11. The ring of claim 8, particularly adapted for use with aircraft engines, wherein said spring is formed of steel.

12. The ring of claim 8, wherein the length of said pin is such that, before connection, said pin is substantially entirely retracted into said ring.

* * * * *